United States Patent [19]

Fallis et al.

[11] Patent Number: 4,708,393

[45] Date of Patent: Nov. 24, 1987

[54] POCKET SEAT CUSHION

[76] Inventors: Mary A. Fallis, 327 Torner Rd., Baltimore, Md. 21221; Joseph F. Urso, 47 Chandelle Rd.; Samuel J. Urso, 502 Middle River Rd., both of Baltimore, Md. 21220

[21] Appl. No.: 936,769

[22] Filed: Dec. 23, 1986

[51] Int. Cl.[4] ..... A47C 7/02

[52] U.S. Cl. ..... 297/452; 5/441; 5/455; 190/2; 297/DIG. 3

[58] Field of Search ..... 5/455, 441, 449; 150/106; 190/1, 2, 8; 383/3, 4; 206/522; 297/DIG. 3, 452

[56] References Cited

U.S. PATENT DOCUMENTS

| | | | |
|---|---|---|---|
| 36,618 | 10/1860 | Linden | 5/449 |
| 3,296,635 | 1/1967 | O'Hanlan | 297/DIG. 3 |
| 3,477,552 | 11/1969 | Goldman | 190/2 |
| 3,818,962 | 6/1974 | Muller-Scherak | 190/2 |

FOREIGN PATENT DOCUMENTS

| | | | |
|---|---|---|---|
| 2157552 | 10/1985 | United Kingdom | 190/1 |

*Primary Examiner*—James T. McCall

*Attorney, Agent, or Firm*—John F. McClellan, Sr.

[57] ABSTRACT

An inflatable seat cushion system has an envelope that will fit in a conventional coat pocket or pocketbook of a user when deflated for storage, includes an envelope having an open side with the open side affixed to the back of the inflatable portion. When the inflatable portion is deflated and folded, preferably, seams as hinge portions, it fits into the integral envelope portion which envelope portion has forward facing margins with fasteners that receive the margins over the folded portions. Pocket-like markings may carry out the theme of "pocket" inflatable cushion.

2 Claims, 8 Drawing Figures

POCKET SEAT CUSHION

FIELD OF THE INVENTION

This invention relates generally to inflatable cushions and particularly to seat cushions that can be compactly stored when not in use.

BACKGROUND OF THE INVENTION

The following U.S. patents relate generally to the field of the invention:

U.S. Pat. No. 3,042,040 to L. H. Keaton, 7-10-62, showed an inflatable cushion that has a pocket attached;

U.S. Pat. No. 3,419,309 to V. Smith, 12-31-68, showed an inflatable cushion that folds into a container when collapsed;

U.S. Pat. No. 3,736,027 to A. P. Stafford, 5-29-76, showed a foldable inflatable cushion.

However, in spite of the fact that most people have at one time or another wanted a cushion for shielding their seats from hard, rough, cold or hot, dirty, sometimes wet seating surfaces, such as some sports stadium seats, for example, a standard item of commerce filling the purpose has not yet been provided. To provide such a system is a principal object of this invention.

Inflatable seat cushions like those generally known have often been too bulky when folded and too difficult to fold, and to carry when not in use, and have had separable cases easily misplaced. Further objects therefore are to provide a system as described that overcomes these problems, by provision of a compact inflatable seat cushion with integral carrying cover that has a novel, efficient orientation, that cannot be separated and lost and that permits the cushion to be folded easily and carried in a pocket of a coat, or the like.

Still further objects are to provide a system as described that is unobtrusive when carried and when in use, that may be transparent or colored, and that in an emergency is usable to shed rain or snow or shield against excessive sun in place of an umbrella, that could serve as a quickly inflatable life preserver in emergency, and that is attractive in appearance, easy to use, low cost, and adaptable to embodiment in various sizes.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
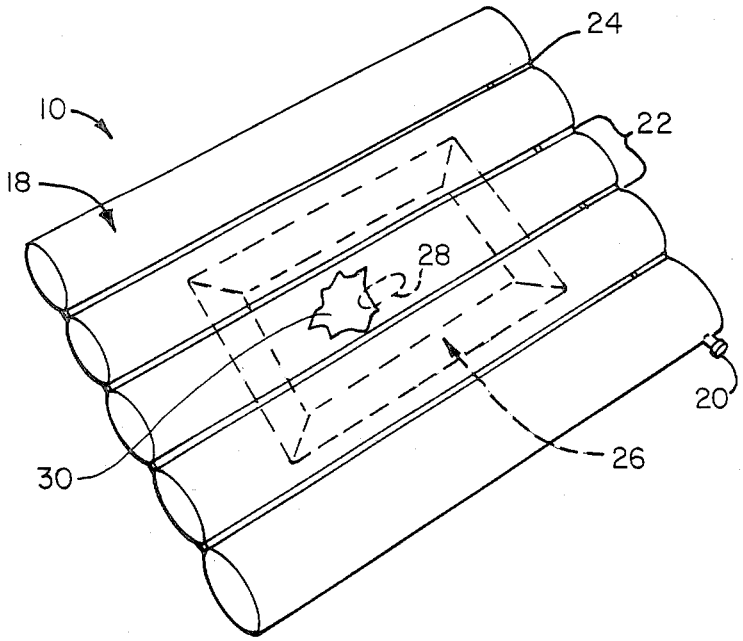
FIG. 1. is a fragmentary perspective view of the preferred embodiment of the inflatable seating cushion of this invention, shown inflated and ready for use.
Figure 2:
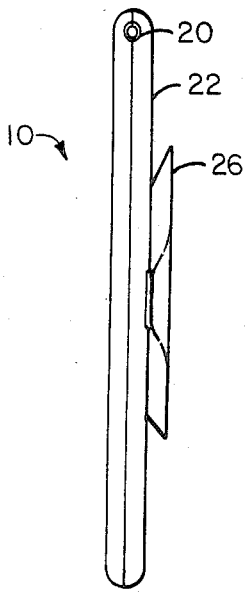
FIG. 2 is an edge view thereof.

FIGS. 1 and 2 show embodiment 10 of the inflatable cushion system of this invention. The system inflatable part 18 is inflated through an ordinary inflation valve 20, that may be a rubber valve inflatable and deflatable through an ordinary inflation needle, or by mouth, and that may have a sealing cap over it.

The cushion may be about 18 inches (45 cm) long and eighteen inches wide, or any suitable size deployed and may fold for storage to pocket size, a few inches on a side. Inflated thickness and width of the conventional tubular portions 22 may be about three inches (7.5 cm). Folded thickness may be less than an inch (2.5 cm). The heat-sealed joints 24 between the tubular portions 22 may be about ½ inch (13 mm) wide. The double-wall thickness may depend on material used, preferably about 0.08 inch (2 mm) if vinyl-impregnated nylon is used.

As will be seen, the invention provides all the good features normally found in inflatable seat cushions and in addition, unique and advantageous folding and storage provisions. A central feature of these provisions is an envelope mechanism 26 affixed as by a thermal plastic patch 28, adhered to the back 30 of the inflatable part 18 with open side against the back for holding the inflatable portion when folded to pocket size.

Figure 3:
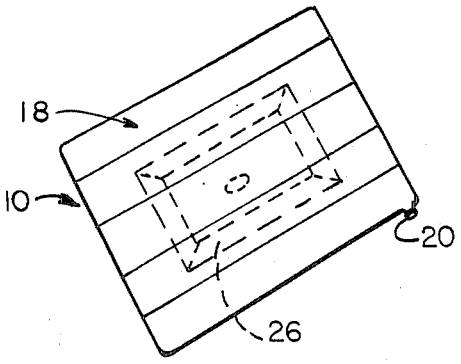
FIG. 3 is a perspective view of the cushion system deflated and ready for folding for pocket-storage.

FIG. 3 shows a first stage of folding of the inflatable system, deflation of the inflatable part 18 (see also FIG. 1), as by opening the valve 20 or by any conventional means for the purpose.

Figure 4:
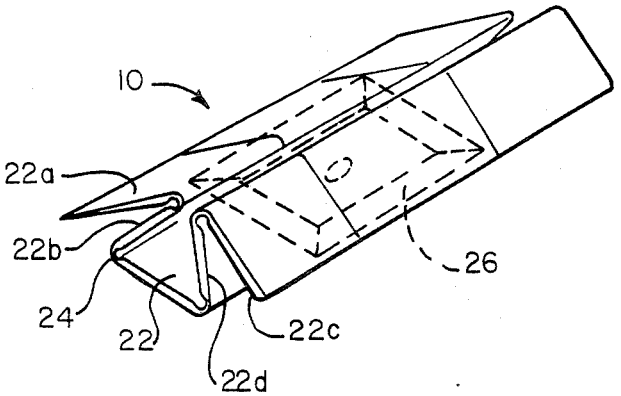
FIG. 4 is a perspective view of the cushion system in a first stage of folding.

FIG. 4 shows a second stage of folding. Preferably the folds are made along the thin heat-sealed joints 24 between the tubular portions 22, and preferably the widths of the deflated tubular portions 22 are slightly less than the widths of the envelope mechanism 26, affixed, as noted, at the center on the back of the inflatable part 18 with the open side of the envelope against the back. This width proportion permits folding of the tubular portions over themselves in two thicknesses *22a, 22b, 22c, 22d* on each side.

Figure 5:
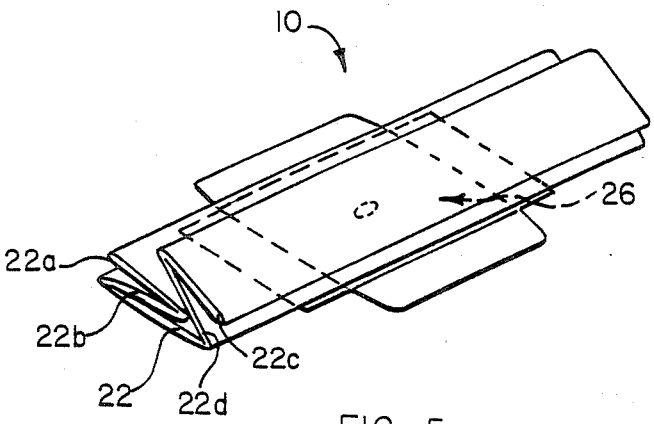
FIG. 5 is a perspective view in a second stage of folding.
Figure 6:
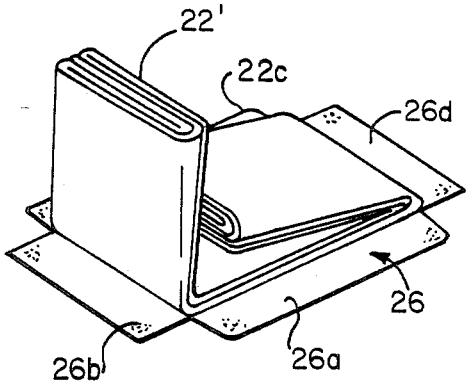
FIG. 6 is a perspective view in a third stage of folding.

FIGS. 5 and 6 show that following this, the ends as at 22 can be folded over the center portion where they fit within the length of the envelope mechanism 26. Flaps or loose margins of the envelope 26 show at *26a, 26b, 26c, 26d.*

Figure 7:
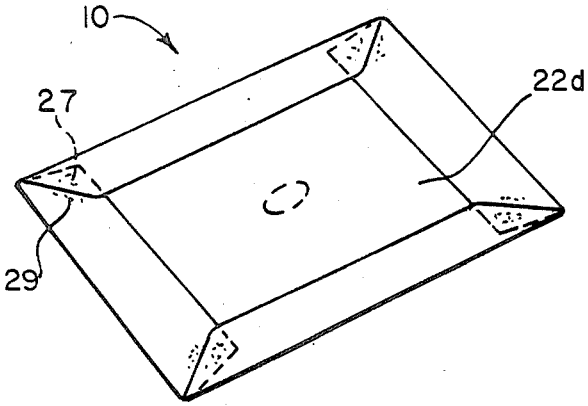
FIG. 7 is a perspective view in a fourth stage, completely folded and secured in pocket size.

FIG. 7 shows that next the flaps or loose margins (*26a, 26b, 26c, 26d,* FIG. 5, for example) of the envelope are folded tubular over the edges of the folded portions, *22d* indicated. The margins may have hook and loop structure at the overlapped corners, securing to themselves as at 27, 29, and containing the inflatable part designated at 18 in FIG. 1. The entire system 10 can be stored as a unit in pocket or pocketbook. Other suitable fastening means may be used instead of the hook and loop structure, but this is flat and less bulky than most. Four margins or side flaps are preferred. These may be notched for easier overlap.

Figure 8:
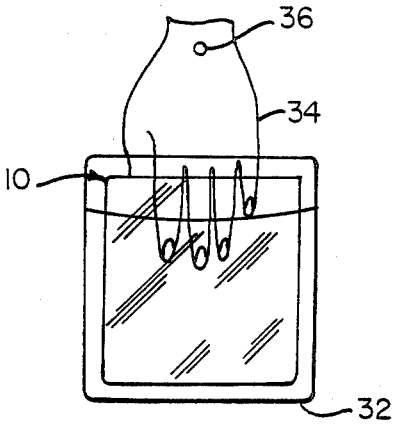
FIG. 8 is an elevational view of a further embodiment held in packaging for sale display.

FIG. 8 shows embodiment 10 in clear-front plastic sales packaging 32 simulating a pocket and illustrating by a simulated nominal-size human hand 34 how a hand can insert the invention in a pocket of a garment. 36 is a hole for hanging the unit.

From the above it will be seen that this invention provides novel and conventional and versatile features that can make life a little easier and safer for people who will use it. Transparent PVC can be used, making the inflatable portion and envelope easy to see through when folding. Either side can be up when the unit is inflated, the flat and flexible envelope mechanism will be more easily kept dust free if used on top, and it is thin enough to be sat upon comfortably when on top. Although a central location is for example, disclosed for the envelope; it is conceivable that a de-centered location depending on mode of folding would be possible, although not preferred.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. A system of inflatable seat cushion and storage for same, characterized by the inflatable seat cushion having a front and a back and being foldable upon itself deflated, said storage comprising: a rectangular envelope with an open face and a plurality of margins therearound foldable over the open face, means for fastening said open face centrally to the back of the inflatable seat cushion and permitting receiving said inflatable seat cushion folded upon itself, centrally within said envelope, and means for detachably securing each of said plurality of margins of said envelope folded over the folded inflatable seat cushion.

2. A system as recited in claim 1, further characterized by having means for furthering association with a pocket including size to fit in conventional-size pockets such as skirt and hip pockets and having pocket markings and bevel corners, said means for detachably securing including overlap of the margins and hook and loop material respectively on the overlapped margins, the inflatable seat cushion having structure indicating fold lines for folding the inflatable seat cushion, and said system being composed substantially of transparent material.

* * * * *